US009287020B2

(12) United States Patent
Gundel et al.

(10) Patent No.: US 9,287,020 B2
(45) Date of Patent: Mar. 15, 2016

(54) ELECTRICAL CABLE ARRANGEMENT

(75) Inventors: Douglas B. Gundel, Cedar Park, TX (US); David L. Kordecki, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/817,496

(22) PCT Filed: Dec. 13, 2010

(86) PCT No.: PCT/US2010/060019

§ 371 (c)(1),
(2), (4) Date: Feb. 18, 2013

(87) PCT Pub. No.: WO2012/030361

PCT Pub. Date: Mar. 8, 2012

(65) Prior Publication Data

US 2013/0240243 A1 Sep. 19, 2013

Related U.S. Application Data

(60) Provisional application No. 61/378,640, filed on Aug. 31, 2010.

(51) Int. Cl.

| | |
|---|---|
| ***H01B 7/08*** | (2006.01) |
| ***H01B 11/20*** | (2006.01) |
| *H01B 11/00* | (2006.01) |

(52) U.S. Cl.

CPC ..... *H01B 7/08* (2013.01); *H01B 7/0838* (2013.01); *H01B 7/0861* (2013.01); *H01B 11/203* (2013.01); *H01B 11/002* (2013.01)

(58) Field of Classification Search

CPC ..... H01B 7/08
USPC ..... 174/117 F, 113 R, 115
See application file for complete search history.

(56) References Cited

U.S. PATENT DOCUMENTS 3,462,542 A * 8/1969 Richter ..... 174/88 R
4,027,941 A * 6/1977 Narozny ..... 439/402

(Continued)

FOREIGN PATENT DOCUMENTS

DE 1810884 * 7/1970
DE 2547152 4/1977

(Continued)

OTHER PUBLICATIONS

International Search Report for PCT/US2010/060019, mailed on Jun. 24, 2011, 5 pages.

*Primary Examiner* — Chau N Nguyen
(74) *Attorney, Agent, or Firm* — Robert S. Moshrefzadeh

(57) ABSTRACT

An electrical cable arrangement comprises a first electrical cable (102) and a second electrical cable (202). The first electrical cable (102) comprises first and second conductor sets (104) and a first carrier film (108). The cable comprises a first pinched portion (108") between the first and second conductor sets (104). The second electrical cable (202) comprises a third conductor set (204) and a second carrier film (208). The first and second carrier films (108, 208) include cover portions (108''', 208''') at least partially covering each of the first and second conductor sets (104) and the third conductor set (204), respectively, and parallel portions (108"), 208") extending from both sides of each of the first and second conductor sets (104) and the third conductor set (204), respectively. The first electrical cable (102) and the second electrical cable (202) extend in substantially the same direction and are arranged in a nested configuration such that the insulated conductors (106) of the third conductor (204) set are disposed within the first pinched portion (108''') of the first electrical cable (102).

6 Claims, 10 Drawing Sheets

(56) References Cited

U.S. PATENT DOCUMENTS

| | | | | | |
|---|---|---|---|---|---|
| 4,171,860 | A | * | 10/1979 | Katz | 439/623 |
| 4,551,576 | A | | 11/1985 | Rich | |
| 4,967,040 | A | * | 10/1990 | Viaud et al. | 174/36 |
| 5,084,594 | A | * | 1/1992 | Cady et al. | 174/36 |
| 6,346,676 | B1 | * | 2/2002 | Caldwell | 174/117 F |
| 6,702,077 | B2 | * | 3/2004 | Skowronski | 191/12.2 R |
| 6,969,807 | B1 | * | 11/2005 | Lin et al. | 174/117 F |
| 2006/0131059 | A1 | * | 6/2006 | Xu et al. | 174/117 F |
| 2012/0090866 | A1 | | 4/2012 | Gundel | |
| 2012/0090872 | A1 | | 4/2012 | Gundel | |
| 2012/0090873 | A1 | | 4/2012 | Gundel | |
| 2012/0097421 | A1 | | 4/2012 | Gundel | |

FOREIGN PATENT DOCUMENTS

| | | | |
|---|---|---|---|
| EP | 0 082 700 | A2 | 6/1983 |
| JP | 59-57806 | | 4/1984 |
| JP | 61-1213 | | 1/1986 |
| JP | H11-329092 | | 11/1999 |
| JP | 2002-117731 | A | 4/2002 |
| WO | WO 2010/148157 | A1 | 12/2010 |
| WO | WO 2010/148161 | A1 | 12/2010 |
| WO | WO 2010/148164 | A2 | 12/2010 |
| WO | WO 2010/148165 | A2 | 12/2010 |

* cited by examiner

ELECTRICAL CABLE ARRANGEMENT

TECHNICAL FIELD

The present disclosure relates generally to electrical cables for the transmission of electrical signals. In particular, the present invention relates to an arrangement of electrical cables that can be mass-terminated and provide high speed electrical properties.

BACKGROUND

Electrical cables for transmission of electrical signals are well known. One common type of electrical cable is a coaxial cable. Coaxial cables generally include an electrically conductive wire surrounded by an insulator. The wire and insulator are surrounded by a shield, and the wire, insulator, and shield are surrounded by a jacket. Another common type of electrical cable is a shielded electrical cable comprising one or more insulated signal conductors surrounded by a shielding layer formed, for example, by a metal foil. To facilitate electrical connection of the shielding layer, a further uninsulated conductor is sometimes provided between the shielding layer and the insulation of the signal conductor or conductors. Both these common types of electrical cable normally require the use of specifically designed connectors for termination and are often not suitable for the use of mass-termination techniques, i.e., the simultaneous connection of a plurality of conductors to individual contact elements, such as, for example, electrical contacts of an electrical connector or contact elements on a printed circuit board. Although electrical cables have been developed to facilitate these mass-termination techniques, these cables often have limitations in the ability to mass-produce them, in the ability to prepare their termination ends, in their flexibility, and in their electrical performance. In view of the advancements in high speed electrical and electronic components, a continuing need exists for electrical cables and electrical cable arrangements that are capable of transmitting high speed signals, facilitate mass-termination techniques, are cost-effective, and can be used in a large number of applications.

SUMMARY

In one aspect, the present invention provides an electrical cable arrangement comprising a first electrical cable and a second electrical cable. The first electrical cable comprises first and second conductor sets including two or more substantially parallel longitudinal insulated conductors and a first carrier film. The first carrier film includes cover portions at least partially covering each of the first and second conductor sets, and parallel portions extending from both sides of each of the first and second conductor sets. The parallel portions form pinched portions of the first electrical cable. The cable comprises a first pinched portion between the first and second conductor sets. The second electrical cable comprises a third conductor set including two or more substantially parallel longitudinal insulated conductors and a second carrier film. The second carrier film includes a cover portion at least partially covering the third conductor set, and parallel portions extending from both sides of the third conductor set. The parallel portions form pinched portions of the second electrical cable. The first electrical cable and the second electrical cable extend in substantially the same direction and are arranged in a nested configuration such that the insulated conductors of the third conductor set are disposed within the first pinched portion of the first electrical cable.

In another aspect, the present invention provides an electrical cable arrangement comprising a first electrical cable and a second electrical cable. The first electrical cable comprises a plurality of spaced apart first conductor sets arranged generally in a single plane and two generally parallel first carrier films disposed around the first conductor sets. Each first conductor set includes one or more substantially parallel longitudinal insulated conductors, a minimum spacing between neighboring first conductor sets being a first distance. The second electrical cable comprises a plurality of spaced apart second conductor sets arranged generally in a single plane and two generally parallel second carrier films disposed around the second conductor sets. Each second conductor set includes one or more substantially parallel longitudinal insulated conductors, a maximum width of the second conductor sets being a second distance less than the first distance. The first electrical cable and the second electrical cable extend in substantially the same direction and are arranged in a nested configuration such that the first conductor sets and second conductor sets overlap along a thickness direction of the electrical cable arrangement.

In another aspect, the present invention provides an electrical cable arrangement comprising first and second shielded electrical cables. Each cable comprises a plurality of conductor sets and first and second shielding films disposed on opposite sides of the cable. The plurality of conductor sets extend along a length of the cable and are spaced apart from each other along a width of the cable. Each conductor set includes one or more insulated conductors. The first and second shielding films include cover portions and pinched portions arranged such that, in transverse cross section, the cover portions of the first and second shielding films in combination substantially surround each conductor set, and the pinched portions of the first and second shielding films in combination form pinched portions of the cable on each side of each conductor set. The second shielded electrical cable is disposed on the first shielded electrical cable such that the conductor sets of each cable are at least partially disposed within the pinched portions of the other cable.

In another aspect, the present invention provides an electrical cable arrangement comprising first and second shielded electrical cables. Each cable comprises a plurality of conductor sets and first and second shielding films disposed on opposite sides of the cable. The plurality of conductor sets extend along a length of the cable and are spaced apart from each other along a width of the cable. Each conductor set includes one or more insulated conductors. The first and second shielding films include cover portions and pinched portions arranged such that, in transverse cross section, the cover portions of the first and second shielding films in combination substantially surround each conductor set, and the pinched portions of the first and second shielding films in combination form pinched portions of the cable on each side of each conductor set. The second shielded electrical cable is disposed on the first shielded electrical cable such that when the electrical cable arrangement is in a planar configuration, the shielding films of the first and second shielded electrical cables overlap along a thickness direction of the cable arrangement.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1A:
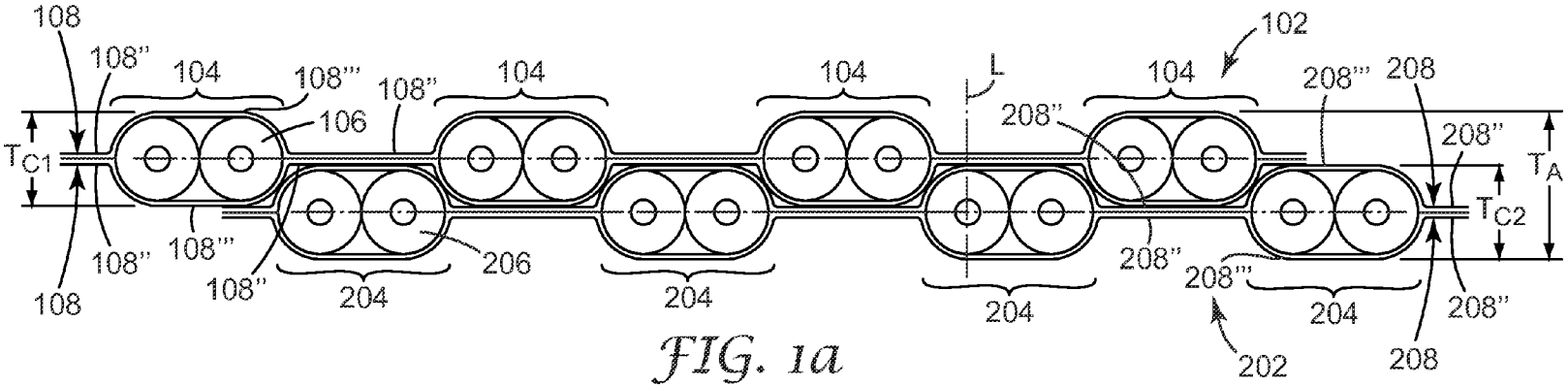
FIGS. 1*a*-1*b* are front cross-sectional views of two exemplary embodiments of an electrical cable arrangement according to aspects of the present invention.

Referring now to the Figures, FIG. 1*a* illustrates an exemplary embodiment of an electrical cable arrangement according to an aspect of the present invention. The electrical cable arrangement includes a first electrical cable 102 and a second electrical cable 202. First electrical cable 102 includes a plurality of spaced apart first conductor sets 104 arranged generally in a single plane. Each first conductor set 104 includes two or more substantially parallel longitudinal insulated conductors 106. A minimum spacing between neighboring first conductor sets 104 is defined as a first distance. First electrical cable 102 further includes two generally parallel first carrier films 108 disposed around first conductor sets 104. Second electrical cable 202 includes a plurality of spaced apart second conductor sets 204 arranged generally in a single plane. Each second conductor set 204 includes one or more substantially parallel longitudinal insulated conductors 206. A maximum width of second conductor sets 204 is defined as a second distance less than the first distance. Second electrical cable 202 further includes two generally parallel second carrier films 208 disposed around second conductor sets 204. First electrical cable 102 and second electrical cable 202 extend in substantially the same direction and are arranged in a nested configuration such that first conductor sets 104 and second conductor sets 204 overlap along a thickness direction L of the electrical cable arrangement.

In one aspect, a nested configuration includes a configuration wherein the electrical cable arrangement has a thickness $T_A$ that is less than the combined thickness of first electrical cable 102 $T_{C1}$ and second electrical cable 202 $T_{C2}$ ($T_A < T_{C1} + T_{C2}$). In one embodiment, if first electrical cable 102 and second electrical cable 202 have the same thickness $T_C$ ($T_C = T_{C1} = T_{C2}$), then the electrical cable arrangement has a thickness $T_A$ of about 1.5 times $T_C$ ($T_A \approx 1.5 \times T_C$). First electrical cable 102 and second electrical cable 202 interpenetrate by approximately 50%. In another aspect, a nested configuration includes a configuration wherein opposing sides of first and second conductor sets 104, 204 at least partially overlap. A nested configuration of first electrical cable 102 and second electrical cable 202 enables a higher linear cable density than a conventional electrical cable arrangement, wherein a first electrical cable and a second electrical cable are, for example, in a stacked configuration, wherein the cable arrangement has a thickness that is equal to the combined thickness of the first electrical cable and the second electrical cable. A higher linear cable density beneficially enables applications wherein the conductor sets can be packed more densely. For example, if insulated conductors 106, 206 are relatively large and the contact elements to which insulated conductors 106, 206 are to be terminated are relatively small, then a higher linear density could be beneficial. Another example is where two or more electrical cables must route through a relatively thin channel. Compared to conventional cable arrangements, other benefits of a cable arrangement wherein electrical cables are arranged in a nested configuration may include a higher degree of electrical shielding between adjacent conductor sets of adjacent electrical cables, mechanical flexibility as a result of sliding between adjacent electrical cables, and the ability to terminate insulated conductors in a longitudinal and/or lateral staggered formation, thereby reducing crosstalk at the termination location.

Still referring to FIG. 1*a*, in other exemplary embodiments, first electrical cable 102 includes at least one first conductor set 104 including one or more substantially parallel longitudinal insulated conductors 106. First electrical cable 102 further includes at least one first carrier film 108. First carrier film 108 includes a cover portion 108''' at least partially covering first conductor set 104, and parallel portions 108'' extending from both sides of first conductor set 104. Second electrical cable 202 includes at least one second conductor set 204 including one or more substantially parallel longitudinal insulated conductors 206. Second electrical cable 202 further includes at least one second carrier film 208. Second carrier film 208 includes a cover portion 208''' at least partially covering second conductor set 204, and parallel portions 208'' extending from both sides of second conductor set 204.

Still referring to FIG. 1*a*, in other exemplary embodiments, first electrical cable 102 includes first and second conductor sets 104, each conductor set 104 including two or more substantially parallel longitudinal insulated conductors 106. First electrical cable 102 further includes a first carrier film 108 including cover portions 108''' at least partially covering each of first and second conductor sets 104, and parallel portions 108'' extending from both sides of each of first and second conductor sets 104. Parallel portions 108'' form pinched portions of first electrical cable 102, first electrical cable 102 including a first pinched portion between first and second conductor sets 104. In one aspect, in the pinched portions, one or both of first carrier films 108 are deflected, bringing parallel portions 108'' of first carrier films 108 into closer proximity. In some configurations, as illustrated in FIG. 1*a*, for example, both of first carrier films 108 are deflected to bring parallel portions 108'' into closer proximity. In some configurations, one of first carrier films 108 may remain relatively flat in the pinched portions when first electrical cable 102 is in a planar or unfolded configuration, and the other first carrier film 108 on the opposite side of first electrical cable 102 may be deflected to bring parallel portions 108'' of first carrier films 108 into closer proximity. Second electrical cable 202 includes a third conductor set 204 including two or more substantially parallel longitudinal insulated conductors 206. Second electrical cable 202 further includes a second carrier film 208 including a cover portion 208''' at least partially covering third conductor set 204, and parallel portions 208" extending from both sides of third conductor set 204. Parallel portions 208" form pinched portions of second electrical cable 202. In one aspect, in the pinched portions, one or both of second carrier films 208 are deflected, bringing parallel portions 208" of second carrier films 208 into closer proximity. In some configurations, as illustrated in FIG. 1*a*, for example, both of second carrier films 208 are deflected to bring parallel portions 208" into closer proximity. In some configurations, one of second carrier films 208 may remain relatively flat in the pinched portions when second electrical cable 202 is in a planar or unfolded configuration, and the other second carrier film 208 on the opposite side of second electrical cable 202 may be deflected to bring parallel portions 208" of second carrier films 208 into closer proximity. First electrical cable 102 and second electrical cable 202 extend in substantially the same direction and are arranged in a nested configuration such that insulated conductors 206 of third conductor set 204 are disposed within the first pinched portion of first electrical cable 102.

Examples of electrical cables that can be used in electrical cable arrangements according to aspects of the present invention are shown and described in U.S. Provisional Patent Application Nos. 61/218,739, 61/260,881, 61/348,800, and 61/352,473, each of which is incorporated by reference herein in its entirety.

Figure 1B:
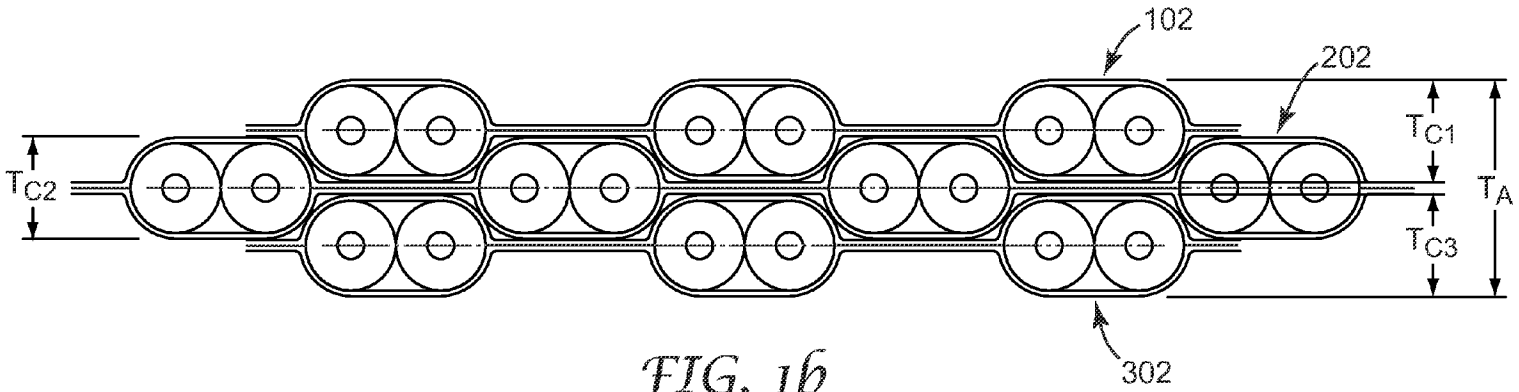

FIG. 1*b* illustrates another exemplary embodiment of an electrical cable arrangement according to an aspect of the present invention. The electrical cable arrangement includes first electrical cable 102 and second electrical cable 202 as described above and illustrated in FIG. 1*a*, and a third electrical cable 302. First electrical cable 102, second electrical cable 202, and third electrical cable 302 are arranged in a nested configuration. The electrical cable arrangement has a thickness $T_A$ that is less than the combined thickness of first electrical cable 102 $T_{C1}$, second electrical cable 202 $T_{C2}$ and third electrical cable 302 $T_{C3}$ ($T_A<T_{C1}+T_{C2}+T_{C3}$). In one embodiment, if first electrical cable 102, second electrical cable 202, and third electrical cable 302 have the same thickness $T_C$ ($T_C=T_{C1}=T_{C2}=T_{C3}$), then the electrical cable arrangement has a thickness $T_A$ of about 2 times $T_C$ ($T_A\approx 2\times T_C$). First electrical cable 102 and second electrical cable 202 as well as second electrical cable 202 and third electrical cable 302 interpenetrate by approximately 50%. From this embodiment, it can be easily understood that, in other embodiments, more than three electrical cables may be similarly arranged in a nested configuration.

Figure 2:
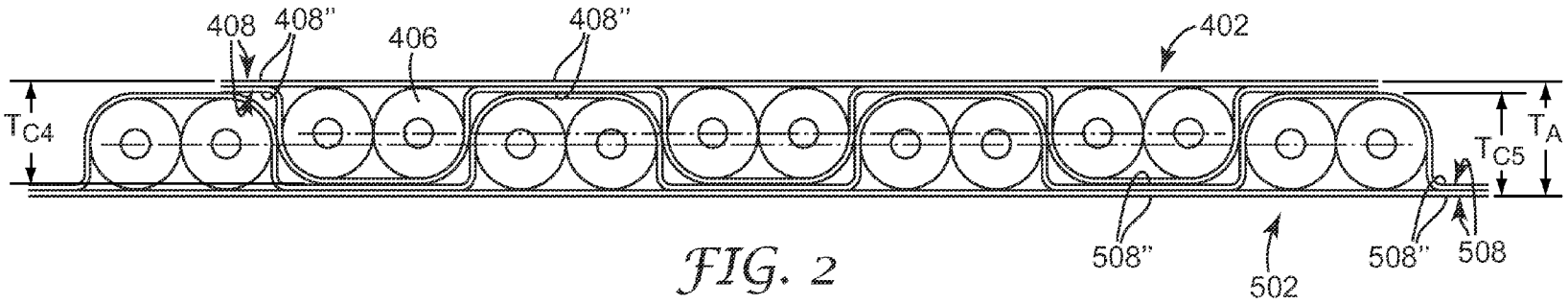
FIG. 2 is a front cross-sectional view of another exemplary embodiment of an electrical cable arrangement according to an aspect of the present invention.

FIG. 2 illustrates another exemplary embodiment of an electrical cable arrangement according to an aspect of the present invention. The electrical cable arrangement includes a first electrical cable 402 and a second electrical cable 502. First electrical cable 402 illustrated in FIG. 2 is similar to first electrical cable 102 illustrated in FIG. 1*a*. Whereas in first electrical cable 102, parallel portions 108" of first carrier films 108 and insulated conductors 106 are arranged generally in a single plane, in first electrical cable 402, parallel portions 408" of first carrier films 408 and insulated conductors 406 are arranged in different planes. Similarly, second electrical cable 502 illustrated in FIG. 2 is similar to second electrical cable 202 illustrated in FIG. 1*a*. Whereas in second electrical cable 202, parallel portions 208" of second carrier films 208 and insulated conductors 206 are arranged generally in a single plane, in second electrical cable 502, parallel portions 508" of second carrier films 508 and insulated conductors 506 are arranged in different planes. First electrical cable 402 and second electrical cable 502 are arranged in a nested configuration. The electrical cable arrangement has a thickness $T_A$ that is less than the combined thickness of first electrical cable 402 $T_{C4}$ and second electrical cable 502 $T_{C5}$ ($T_A<T_{C4}+T_{C5}$). In one embodiment, if first electrical cable 402 and second electrical cable 502 have the same thickness $T_C$ ($T_C=T_{C4}=T_{C5}$), then the electrical cable arrangement has a thickness $T_A$ of about equal to $T_C$ ($T_A\approx T_C$). First electrical cable 402 and second electrical cable 502 interpenetrate by approximately 100%.

Figure 3A:
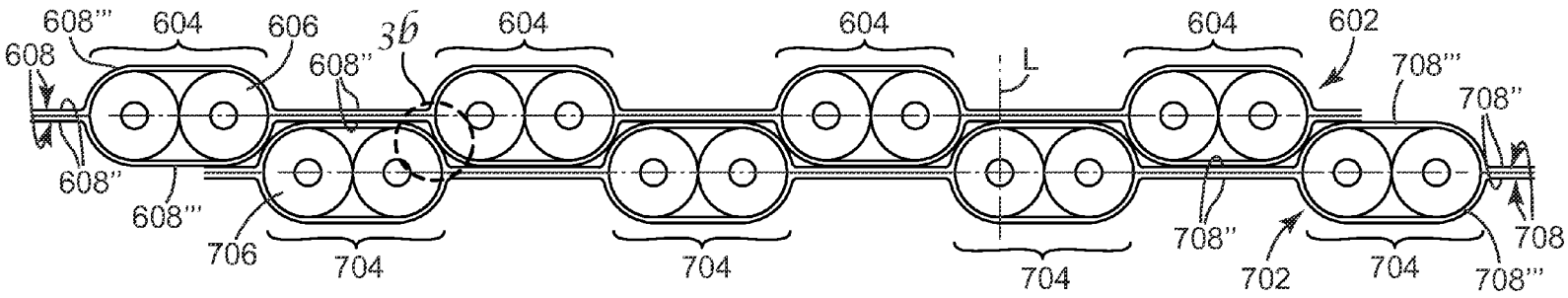
FIGS. 3*a*-3*b* are a front cross-sectional view and a detail view, respectively, of another exemplary embodiment of an electrical cable arrangement according to an aspect of the present invention.
Figure 3B:
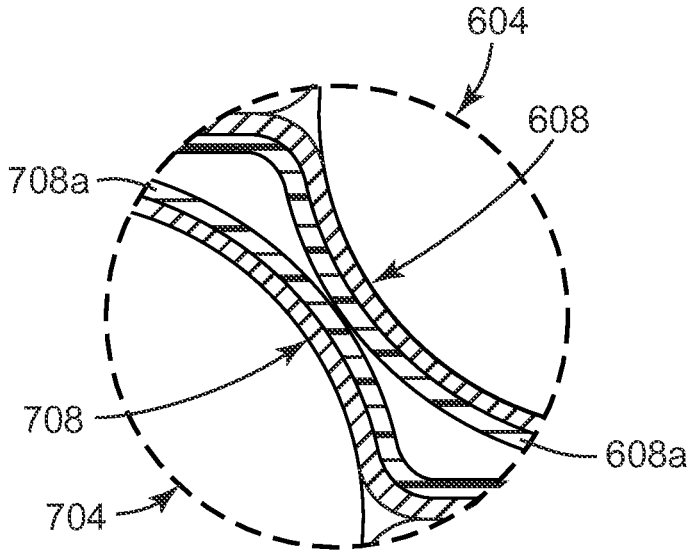

FIGS. 3*a*-3*b* illustrate another exemplary embodiment of an electrical cable arrangement according to an aspect of the present invention. The electrical cable arrangement includes a first electrical cable 602 and a second electrical cable 702. First electrical cable 602 illustrated in FIGS. 3*a*-3*b* is similar to first electrical cable 102 illustrated in FIG. 1*a*. As can be seen in FIG. 3*b*, first carrier films 608 include a conductive layer 608*a*, in which case first carrier films 608 may be referred to as first shielding films 608. Similarly, second electrical cable 702 illustrated in FIGS. 3*a*-3*b* is similar to second electrical cable 202 illustrated in FIG. 1*a*. As can be seen in FIG. 3*b*, second carrier films 708 include a conductive layer 708*a*, in which case second carrier films 708 may be referred to as second shielding films 708. First electrical cable 602 and second electrical cable 702 are arranged in a nested configuration. In this nested configuration, as can be seen in FIG. 3*b*, a portion of first shielding films 608 (including conductive layer 608*a*) and a portion of second shielding films 708 (including conductive layer 708*a*) are disposed between first conductor set 604 of first electrical cable 602 and second conductor set 704 of second electrical cable 702, effectively resulting in two layers of shielding between the closest neighboring first conductor set 604 and second conductor set 704, compared to conventional cable arrangements, providing a higher degree of electrical shielding between adjacent conductor sets of adjacent electrical cables. In another embodiment, only first carrier films 608 include a conductive layer 608*a*, in which case first carrier films 608 may be referred to as first shielding films 608. First electrical cable 602 and second electrical cable 702 are arranged in a nested configuration. In this nested configuration, a portion of first shielding films 608 (including conductive layer 608*a*) is disposed between first conductor set 604 of first electrical cable 602 and second conductor set 704 of second electrical cable 702, effectively resulting in one layer of shielding between the closest neighboring first conductor set 604 and second conductor set 704.

Still referring to FIGS. 3*a*-3*b*, in other exemplary embodiments, the electrical cable arrangement includes first and second shielded electrical cables 602, 702. Each cable comprises a plurality of conductor sets 604, 704 and first and second shielding films 608, 708 disposed on opposite sides of the cable. The plurality of conductor sets 604, 704 extend along a length of the cable and are spaced apart from each other along a width of the cable. Each conductor set 604, 704 includes one or more insulated conductors 606, 706. First and second shielding films 608, 708 include cover portions 608''', 708''' and pinched portions 608", 708" arranged such that, in transverse cross section, cover portions 608", 708" of first and second shielding films 608, 708 in combination substantially surround each conductor set 604, 704, and pinched portions 608", 708" of first and second shielding films 608, 708 in combination form pinched portions 608", 708" of the cable on each side of each conductor set 604, 704.

In one embodiment, second shielded electrical cable 702 is disposed on first shielded electrical cable 602 such that the conductor sets of each cable are at least partially disposed within the pinched portions of the other cable. Shielding films 608, 708 of first and second shielded electrical cables 602, 702 may overlap along a thickness direction L of the electrical cable arrangement. At least one of first and second shielded electrical cables 602, 702 may include a conductor set 604, 704 that comprises two or more insulated conductors 606, 706. The electrical cable arrangement may have a maximum thickness that is at least 40% less than a sum of maximum thicknesses of first and second shielded electrical cables 602, 702. The electrical cable arrangement may have a minimum thickness that is at most 40% greater than a sum of minimum thicknesses of first and second shielded electrical cables 602, 702. First shielding film 608, 708 of at least one of the first and second shielded electrical cables 602, 702 may be more planar than second shielding film 608, 708.

In another embodiment, second shielded electrical cable 702 is disposed on first shielded electrical cable 602 such that when the electrical cable arrangement is in a planar configuration, shielding films 608, 708 of first and second shielded electrical cables 602, 702 overlap along a thickness direction L of the electrical cable arrangement. The conductor sets of each cable may be at least partially disposed within the pinched portions of the other cable.

A nested configuration of electrical cables provides a way to reduce the stiffness of a given number of conductor sets relative to the same number of conductor sets in a conventional configuration. Although the stiffness of each electrical cable is the same regardless of whether it is in a nested configuration or a conventional configuration, the effective thickness of the electrical cable arrangement $T_A$ is reduced, thereby dramatically reducing the area moment of inertia of the electrical cable arrangement. A nested configuration of electrical cables allows the neutral bending axes for the electrical cables in an arrangement to become more coincident, as can be seen, for example, in FIGS. 1*a* and 2. This reduces the stiffness and strain difference of the insulated conductors if they are bent together around a given radius, for example.

Figure 4:
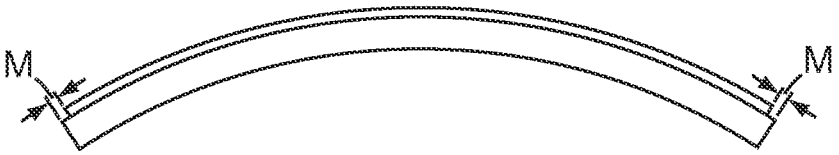
FIG. 4 is a schematic side view of a bent portion of an electrical cable arrangement according to an aspect of the present invention.

If in an electrical cable arrangement the electrical cable ends are not constrained and the electrical cables can move (slide) relative to each other, an arrangement wherein the electrical cables are arranged in a nested configuration will produce less mismatch M of the electrical cable ends during bending (see FIG. 4) than an arrangement wherein the electrical cables are arranged in a conventional configuration. Alternatively, if in an electrical cable arrangement the electrical cable ends are constrained, the differential strain and stress will have to be accommodated in the electrical cables. In an arrangement wherein the electrical cables are arranged in a nested configuration this differential stress and strain will be lower than in an arrangement wherein the electrical cables are arranged in a conventional configuration.

Figure 5:
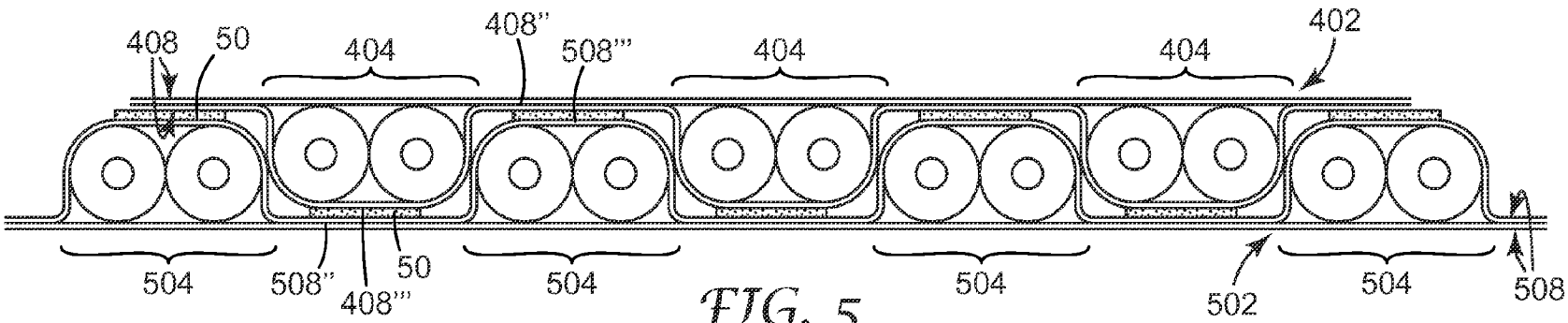
FIG. 5 is a front cross-sectional view of another exemplary embodiment of an electrical cable arrangement according to an aspect of the present invention.

FIG. 5 illustrates another exemplary embodiment of an electrical cable arrangement according to an aspect of the present invention. The electrical cable arrangement includes a first electrical cable 402 and a second electrical cable 502 similar to the electrical cable arrangement illustrated in FIG. 2. In the exemplary embodiment illustrated in FIG. 5, first electrical cable 402 and second electrical cable 502 are bonded together by an adhesive 50 disposed between them. Adhesive 50 can be any adhesive suitable for the intended application. Adhesive 50 may include an insulative adhesive and provide an insulative bond between first electrical cable 402 and second electrical cable 502. Adhesive 50 may include a conductive adhesive and provide a conductive bond between first electrical cable 402 and second electrical cable 502. Suitable conductive adhesives include conductive particles to provide the flow of electrical current. The conductive particles can be any of the types of particles currently used, such as spheres, flakes, rods, cubes, amorphous, or other particle shapes. They may be solid or substantially solid particles such as carbon black, carbon fibers, nickel spheres, nickel coated copper spheres, metal-coated oxides, metal-coated polymer fibers, or other similar conductive particles. These conductive particles can be made from electrically insulating materials that are plated or coated with a conductive material such as silver, aluminum, nickel, or indium tin-oxide. The metal-coated insulating material can be substantially hollow particles such as hollow glass spheres, or may comprise solid materials such as glass beads or metal oxides. The conductive particles may be on the order of several tens of microns to nanometer sized materials such as carbon nanotubes. Suitable conductive adhesives may also include a conductive polymeric matrix. In one embodiment, adhesive 50 includes at least one of a pressure sensitive adhesive, a hot melt adhesive, a thermoset adhesive, and a curable adhesive. In one embodiment, adhesive 50 has a thickness of less than about 0.13 mm. In a preferred embodiment, adhesive 50 has a thickness of less than about 0.05 mm. Adhesive 50 may be disposed between first electrical cable 402 and second electrical cable 502 as suitable for the intended application. In the embodiment illustrated in FIG. 5, adhesive 50 is disposed between cover portions 408' of a first carrier film 408 of first electrical cable 402 and opposing parallel portions 508" of a second carrier film 508 of second electrical cable 502, and between parallel portions 408" of a first carrier film 408 of first electrical cable 402 and opposing cover portions 508' of a second carrier film 508 of second electrical cable 502.

Figure 6A:
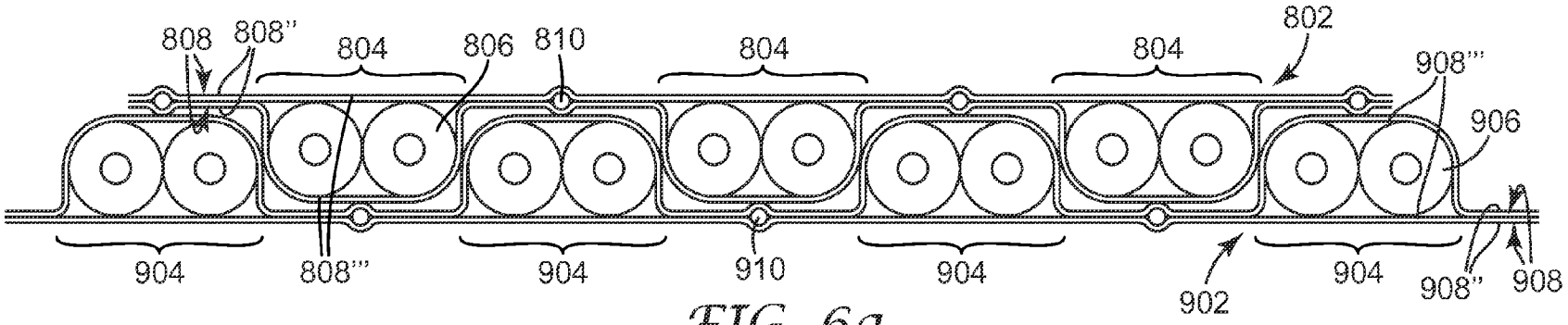
FIGS. 6*a*-6*b* are front cross-sectional views of two other exemplary embodiments of an electrical cable arrangement according to aspects of the present invention.
Figure 6B:
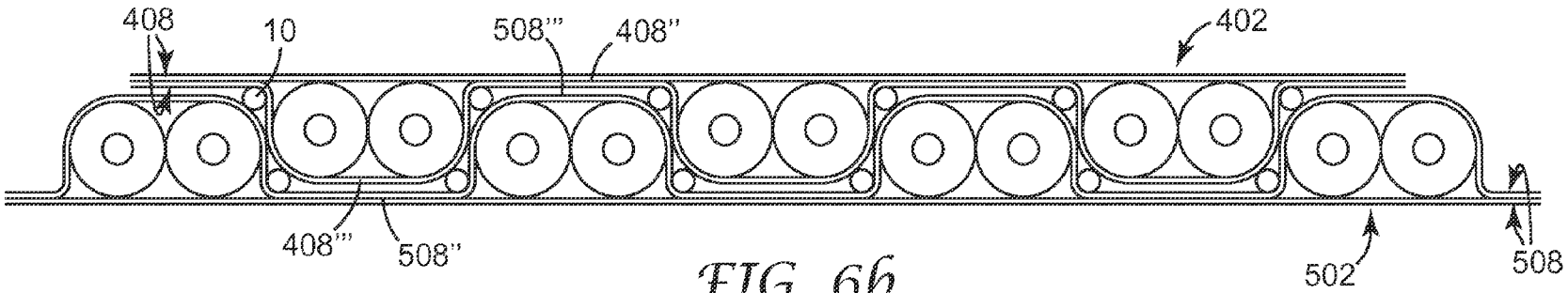

In one aspect, an electrical cable arrangement according to the present invention including a first electrical cable and a second electrical cable arranged in a nested configuration may include at least one longitudinal ground conductor extending in substantially the same direction as one or more insulated conductors of at least one of a first conductor set of the first electrical cable and a second conductor set of the second electrical cable. Two exemplary embodiments of such an electrical cable arrangement are illustrated in FIGS. 6*a*-6*b*. One or more ground conductors may be included in at least one of the first electrical cable and the second electrical cable. Alternatively, one or more ground conductors may be disposed between the first electrical cable and the second electrical cable. The ground conductors may include ground wires or drain wires.

The exemplary embodiment of an electrical cable arrangement according to an aspect of the present invention illustrated in FIG. 6*a* includes a first electrical cable 802 and a second electrical cable 902. First electrical cable 802 includes a plurality of spaced apart first conductor sets 804 arranged generally in a single plane. Each first conductor set 804 includes one or more substantially parallel longitudinal insulated conductors 806. First electrical cable 802 further includes two generally parallel first carrier films 808 disposed around first conductor sets 804. First carrier films 808 each include cover portions 808' partially covering first conductor sets 804, and parallel portions 808" extending from both sides of first conductor sets 804. Second electrical cable 902 includes a plurality of spaced apart second conductor sets 904 arranged generally in a single plane. Each second conductor set 904 includes one or more substantially parallel longitudinal insulated conductors 906. Second electrical cable 902 further includes two generally parallel second carrier films 908 disposed around second conductor sets 904. Second carrier films 908 each include cover portions 908' partially covering second conductor sets 904, and parallel portions 908" extending from both sides of second conductor sets 904. First electrical cable 802 and second electrical cable 902 extend in substantially the same direction and are arranged in a nested configuration. First electrical cable 802 is similar to first electrical cable 402 illustrated in FIG. 2, but additionally includes a plurality of ground conductors 810 disposed between first carrier films 808 in parallel portions 808". Second electrical cable 902 is similar to second electrical cable 502 illustrated in FIG. 2, but additionally includes a plurality of ground conductors 910 disposed between second carrier films 908 in parallel portions 908".

One of or both first carrier films 808 may include a conductive layer (not shown), in which case it may be referred to as first shielding film 808. At least one of ground conductors 810 may then make direct or indirect electrical contact with this first shielding film 808. Similarly, one of or both second carrier films 908 may include a conductive layer (not shown), in which case it may be referred to as second shielding film 908. At least one of ground conductors 910 may then make direct or indirect electrical contact with this second shielding film 908. Direct or indirect electrical contact between a ground conductor and a shielding film may improve the electrical performance of the electrical cable arrangement. For example, referring to FIG. 6*a*, ground conductors 810 may facilitate direct or indirect electrical contact between two first shielding films 808, ground conductors 910 may facilitate direct or indirect electrical contact between two second shielding films 908, ground conductors 810 may facilitate direct or indirect electrical contact between a first shielding film 808, e.g., at parallel portions 808", and a second shielding film 908, e.g., at cover portions 908'", and ground conductors 910 may facilitate direct or indirect electrical contact between a first shielding film 808, e.g., at cover portions 808', and a second shielding film 908, e.g., at parallel portions 908". Further, direct or indirect electrical contact between a ground conductor and a shielding film may facilitate termination of the shielding film to any suitable individual contact element of any suitable termination point, such as, e.g., a contact element on a printed circuit board or an electrical contact of an electrical connector. Examples of establishing direct or indirect electrical contact between a ground conductor and a shielding film are described in U.S. Provisional Patent Application Nos. 61/218,739, 61/260,881, 61/348,800, and 61/352,473.

The exemplary embodiment of an electrical cable arrangement according to an aspect of the present invention illustrated in FIG. 6*b* is similar to the electrical cable arrangement illustrated FIG. 2, but additionally includes a plurality of ground conductors 10 disposed between first electrical cable 402 and second electrical cable 502. First carrier film 408 facing towards second electrical cable 502 may include a conductive layer (not shown), in which case it may be referred to as first shielding film 408. Similarly, second carrier film 508 facing towards first electrical cable 402 may include a conductive layer (not shown), in which case it may be referred to as second shielding film 508. At least one of ground conductors 10 may then make direct or indirect electrical contact with this first shielding film 408 and/or this second shielding film 508 as described above. Ground conductors 10 may be disposed between first electrical cable 402 and second electrical cable 502 in any suitable location, such as, e.g., where cover portions 408'" and 508'" transition into parallel portions 408" and 508", respectively, and vice versa, as illustrated in FIG. 6*b*.

One or more additional ground conductors 10 may be disposed on first carrier film 408 facing away from second electrical cable 502 and/or second carrier film 508 facing away from first electrical cable 402 using any suitable method, including mechanical clamping and adhesively bonding, to name a few. First carrier film 408 facing away from second electrical cable 502 may include a conductive layer (not shown), in which case it may be referred to as first shielding film 408. Similarly, second carrier film 508 facing away from first electrical cable 402 may include a conductive layer (not shown), in which case it may be referred to as second shielding film 508. The one or more additional ground conductors 10 may then make direct or indirect electrical contact with this first shielding film 408 and/or this second shielding film 508 as described above.

As described above, compared to conventional electrical cable arrangements, a benefit of electrical cable arrangements according to aspects of the present invention wherein electrical cables are arranged in a nested configuration is a higher linear cable density, in particular in areas where limited space is available, such as, e.g., a cable termination location or where the electrical cables have to fit through a small channel.

FIG. 7*a*-8*f* illustrate various exemplary embodiments of an electrical cable arrangement according to aspects of the present invention in a terminated configuration, illustrating how electrical cables arrangements according to aspects of the present invention wherein electrical cables are arranged in a nested configuration can be terminated to a linear array of contact elements, such as, e.g., contact elements on a printed circuit board (including a flexible circuit, a paddle card, and the like). If a conventional electrical cable arrangement were to be terminated to this linear array of contact elements, the thickness $T_A$ of the electrical cable arrangement in this location would be larger, the length of the conductor that spans from the electrical cable to the corresponding contact element would be greater (thereby reducing the signal integrity at the termination point), and the stiffness of the electrical cable arrangement bending away from the termination point would be larger.

Figure 8A:
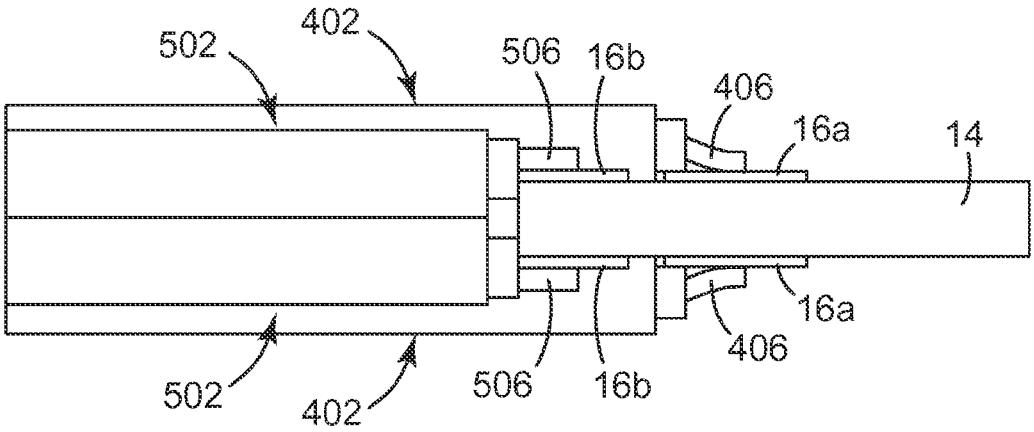
FIGS. 8*a*-8*f* are side views of an end portion of the electrical cable arrangements of FIGS. 7*a*-7*f*, respectively, in a terminated configuration.
Figure 8B:
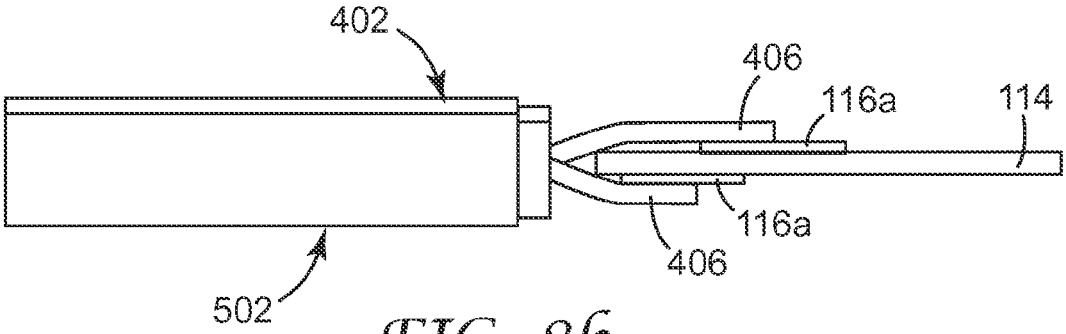
Figure 8C:
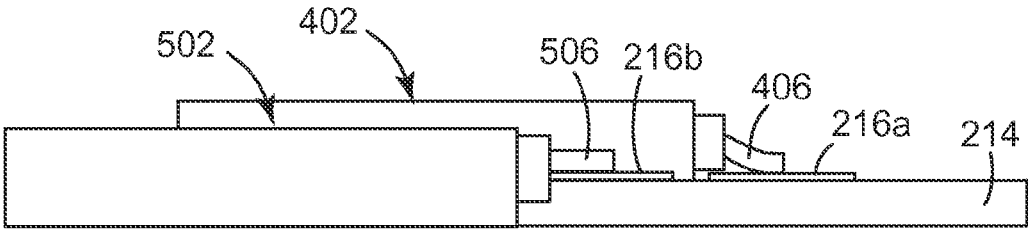

Providing a longitudinally staggered termination of an electrical cable arrangement wherein the electrical cables are arranged in a nested configuration may further enhance the associated signal integrity and termination density. Examples of longitudinally staggered terminations are illustrated in FIGS. 8*a*, 8*b* and 8*c*. With increased density of a single electrical cable, neighboring conductor sets are in close proximity, which increases the likelihood of crosstalk between the conductor sets at the termination location. An electrical cable arrangement wherein the electrical cables are arranged in a nested configuration enables termination locations of neighboring conductor sets to be longitudinally staggered in a simple manner, thereby providing greater crosstalk isolation. Further, a longitudinally staggered termination allows the location of larger contact elements on a printed circuit board to be staggered, thereby increasing the associated termination density. Even in case of a longitudinally staggered termination, the electrical cables can be independently mass-terminated, which preserves the cost-effectiveness associated with mass-termination.

Figure 7B:
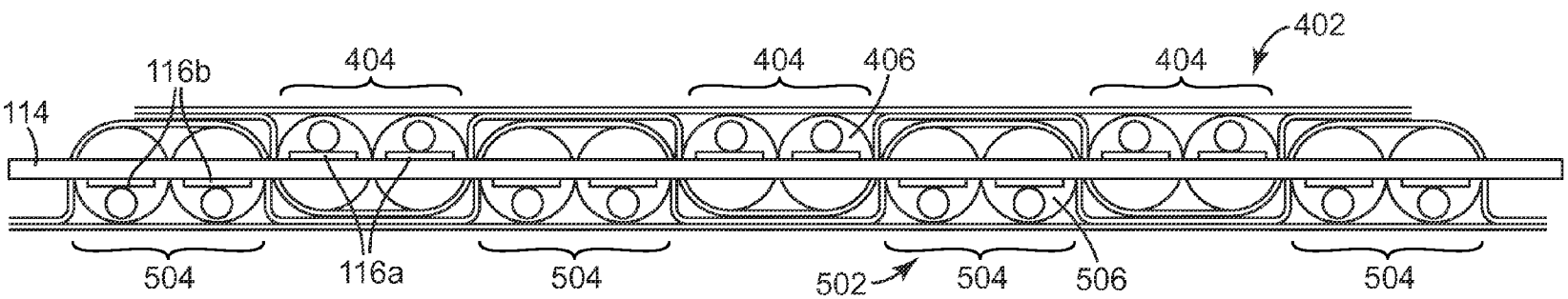
Figure 7D:
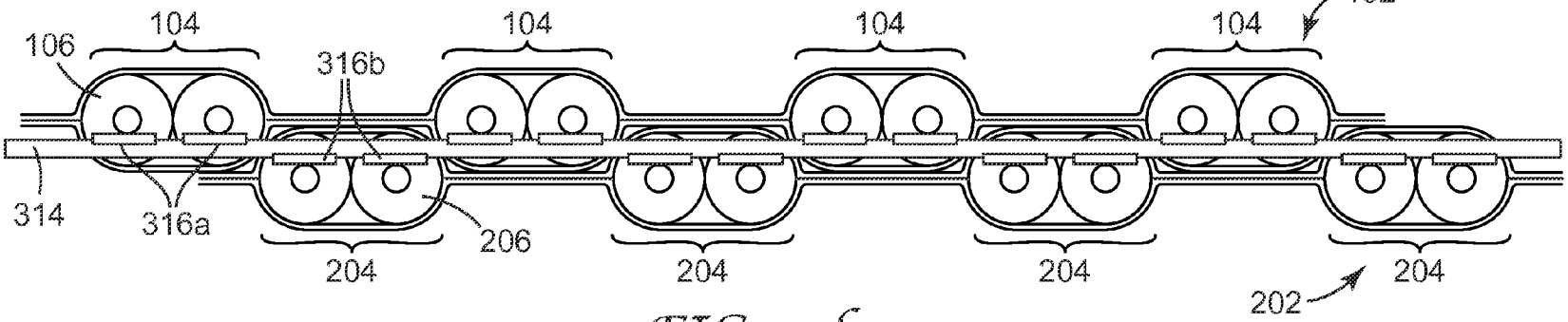
Figure 8D:
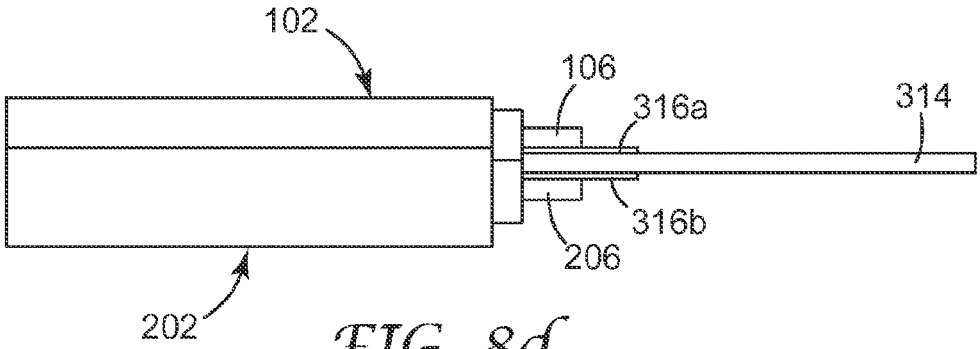

One common method to electrically isolate signals is to carry data in one direction on one conductor set ("send" conductor set) and carry data in the opposite direction on another conductor set ("receive" conductor set). In this case, termination of the "send" conductor set close to the termination of the "receive" conductor set at one end can produce crosstalk between the two conductor sets. An effective method to reduce this crosstalk is to provide a termination of an electrical cable arrangement wherein the electrical cables are arranged in a nested configuration and terminated on opposite sides of a printed circuit board. Examples of this termination are illustrated in FIGS. 8*b* and 8*d*. Further enhancement of the associated signal integrity and termination density may then be achieved by providing a laterally staggered termination. An electrical cable arrangement wherein the electrical cables are arranged in a nested configuration enables termination locations of neighboring conductor sets to be laterally staggered in a simple manner, thereby providing greater crosstalk isolation while maintaining the high linear cable density and termination density. Examples of laterally staggered terminations are illustrated in FIGS. 7*b* and 7*d*. As illustrated in FIGS. 7*b* and 8*b*, lateral staggering may be combined with longitudinal staggering to achieve further enhancement of the associated signal integrity and termination density, for example.

Figure 7A:
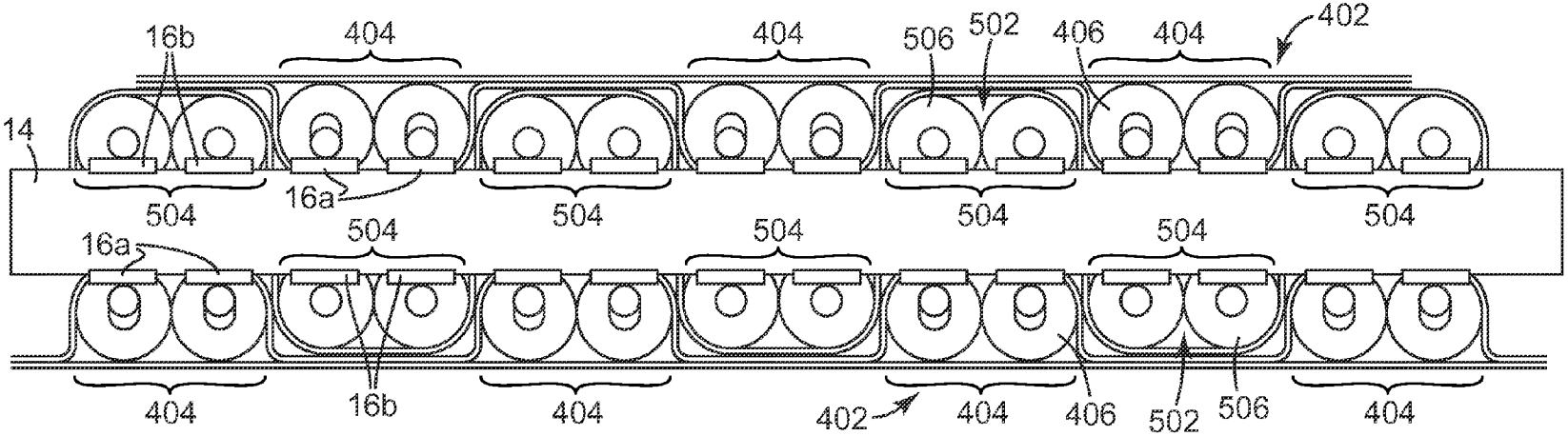
FIGS. 7*a*-7*f* are front cross-sectional views of various other exemplary embodiments of an electrical cable arrangement according to aspects of the present invention in a terminated configuration.

FIGS. 7*a* and 8*a* illustrate two representations of the electrical cable arrangement illustrated in FIG. 2 including a first electrical cable 402 and a second electrical cable 502 terminated to a printed circuit board 14. One representation is terminated to one side of printed circuit board 14 and the other representation is terminated to the other side of printed circuit board 14. Specifically, for each representation, insulated conductors 406 of first conductor sets 404 of first electrical cables 402 are terminated to a first linear array of contact elements 16*a*, and insulated conductors 506 of second conductor sets 504 of second electrical cables 502 are terminated to a second linear array of contact elements 16*b*. In the embodiment illustrated in FIGS. 7*a* and 8*a*, to facilitate this termination, the end portions of insulated conductors 506 extend substantially parallel from electrical cable 502 for proper alignment with corresponding contact elements 16*b* while the end portions of insulated conductors 406 are bent towards printed circuit board 14 for proper alignment with corresponding contact elements 16*a*. Contact elements 16*a* and 16*b* are not laterally staggered (see FIG. 7*a*) but longitudinally staggered (see FIG. 8*a*), and first linear array of contact elements 16*a* and second linear array of contact elements 16*b* are disposed in a single plane.

FIGS. 7*b* and 8*b* illustrate the electrical cable arrangement illustrated in FIG. 2 including a first electrical cable 402 and a second electrical cable 502 terminated to a printed circuit board 114. Specifically, insulated conductors 406 of first conductor sets 404 of first electrical cable 402 are terminated to a first linear array of contact elements 116*a* disposed on one side of printed circuit board 114, and insulated conductors 506 of second conductor sets 504 of second electrical cable 502 are terminated to a second linear array of contact elements 116*b* disposed on the other side of printed circuit board 114. In the embodiment illustrated in FIGS. 7*b* and 8*b*, to facilitate this termination, the end portions of insulated conductors 406, 506 are bent away from printed circuit board 114 for proper alignment with corresponding contact elements 116*a*, 116*b*. Contact elements 116*a* and 116*b* are laterally staggered (see FIG. 7*b*) and longitudinally staggered (see FIG. 8*b*), and first linear array of contact elements 116*a* and second linear array of contact elements 116*b* are disposed in different planes.

Figure 7C:
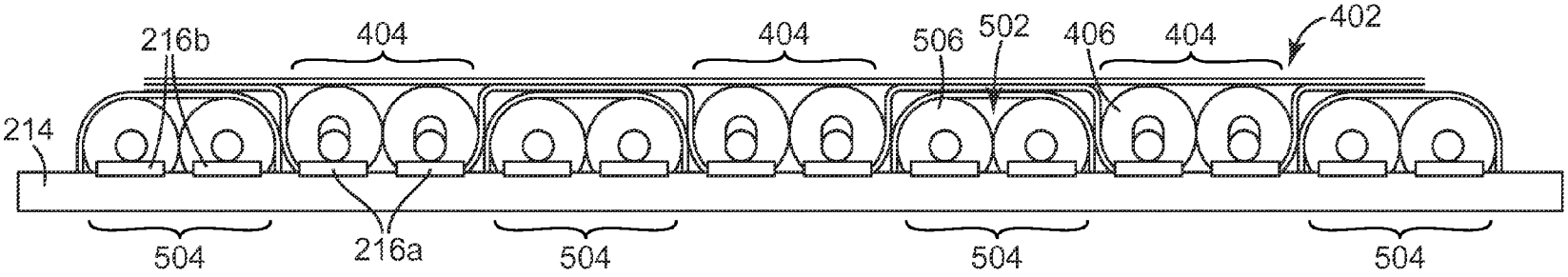

FIGS. 7*c* and 8*c* illustrate the electrical cable arrangement illustrated in FIG. 2 including a first electrical cable 402 and a second electrical cable 502 terminated to one side of a printed circuit board 214. Specifically, insulated conductors 406 of first conductor sets 404 of first electrical cable 402 are terminated to a first linear array of contact elements 216*a*, and insulated conductors 506 of second conductor sets 504 of second electrical cable 502 are terminated to a second linear array of contact elements 216*b*. In the embodiment illustrated in FIGS. 7*c* and 8*c*, to facilitate this termination, the end portions of insulated conductors 506 extend substantially parallel from electrical cable 502 for proper alignment with corresponding contact elements 216*b* while the end portions of insulated conductors 406 are bent towards printed circuit board 214 for proper alignment with corresponding contact elements 216*a*. Contact elements 216*a* and 216*b* are not laterally staggered (see FIG. 7*c*) but longitudinally staggered (see FIG. 8*c*), and first linear array of contact elements 216*a* and second linear array of contact elements 216*b* are disposed in a single plane.

FIGS. 7*d* and 8*d* illustrate the electrical cable arrangement illustrated in FIG. 1*a* including a first electrical cable 102 and a second electrical cable 202 terminated to a printed circuit board 314. Specifically, insulated conductors 106 of first conductor sets 104 of first electrical cable 102 are terminated to a first linear array of contact elements 316*a* disposed on one side of printed circuit board 314, and insulated conductors 206 of second conductor sets 204 of second electrical cable 202 are terminated to a second linear array of contact elements 316*b* disposed on the other side of printed circuit board 314. In the embodiment illustrated in FIGS. 7*d* and 8*d*, to facilitate this termination, the end portions of insulated conductors 106, 206 extend substantially parallel from electrical cables 102, 202 for proper alignment with corresponding contact elements 316*a*, 316*b*. Contact elements 316*a* and 316*b* are laterally staggered (see FIG. 7*d*) but not longitudinally staggered (see FIG. 8*d*), and first linear array of contact elements 316*a* and second linear array of contact elements 316*b* are disposed in different planes.

Figure 7E:
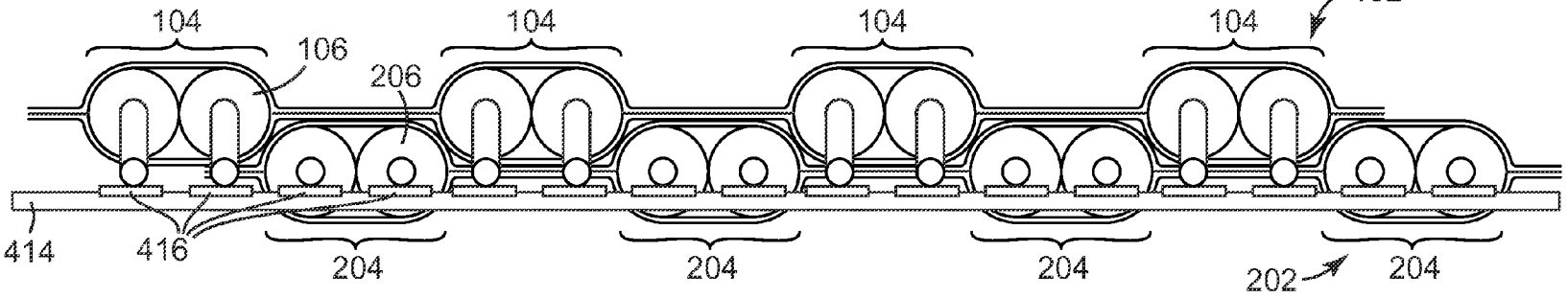
Figure 8E:
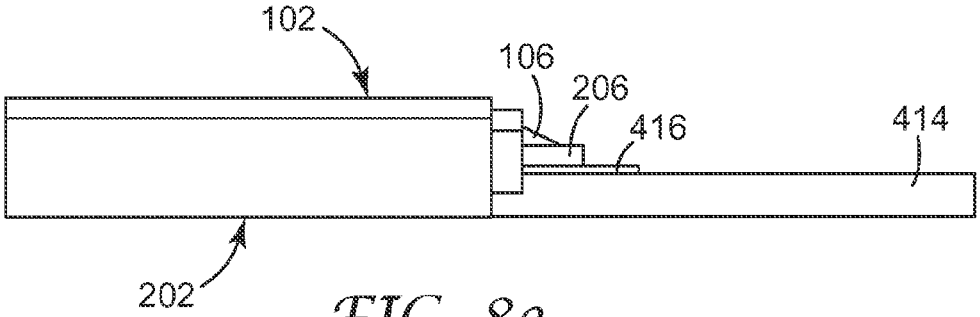

FIGS. 7*e* and 8*e* illustrate the electrical cable arrangement illustrated in FIG. 1*a* including a first electrical cable 102 and a second electrical cable 202 terminated to one side of a printed circuit board 414. Specifically, both insulated conductors 106 of first conductor sets 104 of first electrical cable 102 and insulated conductors 206 of second conductor sets 204 of second electrical cable 202 are terminated to a single linear array of contact elements 416. In the embodiment illustrated in FIGS. 7*e* and 8*e*, to facilitate this termination, the end portions of insulated conductors 206 extend substantially parallel from electrical cable 202 for proper alignment with corresponding contact elements 416 while the end portions of insulated conductors 106 are bent towards printed circuit board 414 for proper alignment with corresponding contact elements 416.

Figure 7F:
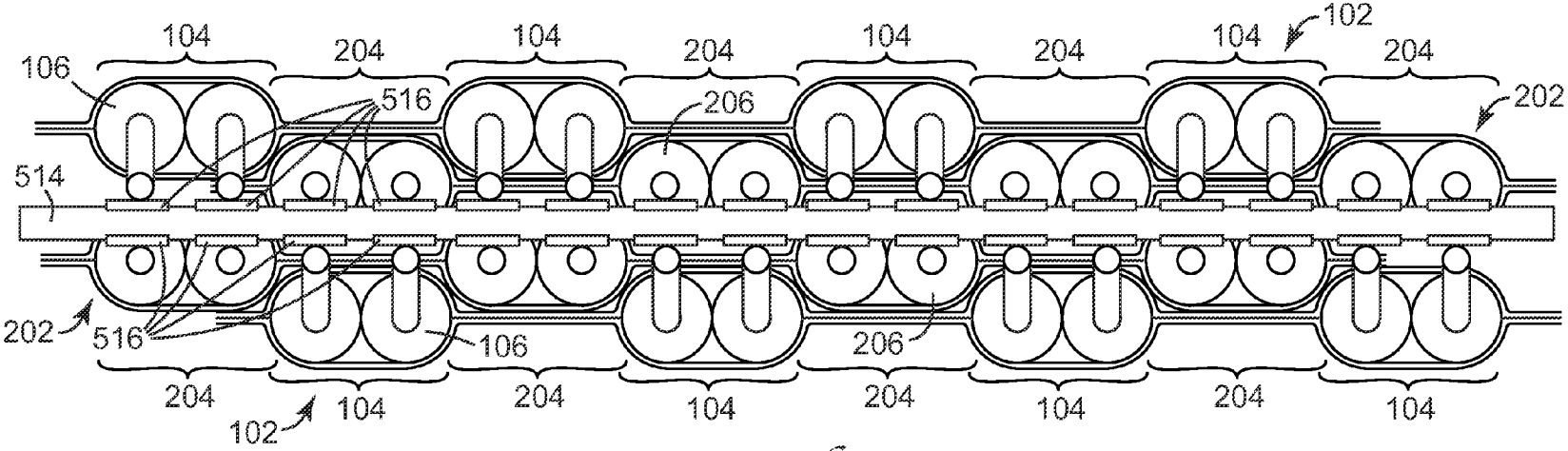
Figure 8F:
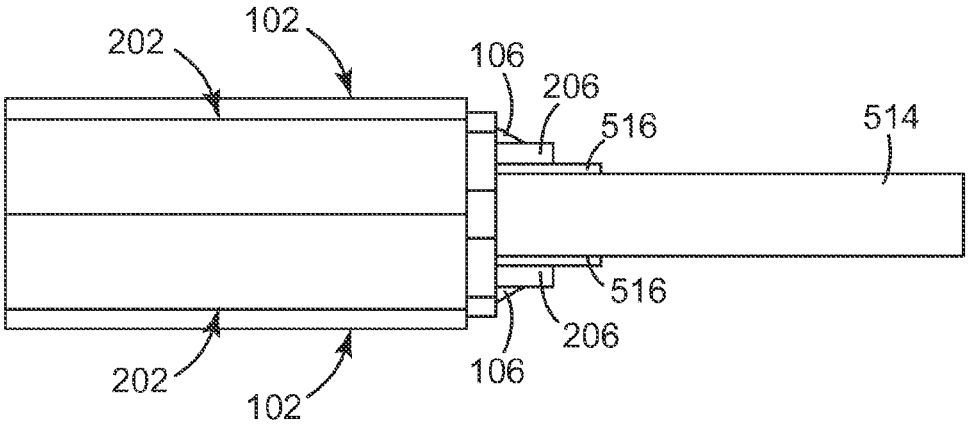

FIGS. 7*f* and 8*f* illustrate two representations of the electrical cable arrangement illustrated in FIG. 1*a* including a first electrical cable 102 and a second electrical cable 202 terminated to a printed circuit board 514. One representation is terminated to one side of printed circuit board 514 and the other representation is terminated to the other side of printed circuit board 514. Specifically, for each representation, both insulated conductors 106 of first conductor sets 104 of first electrical cables 102 and insulated conductors 206 of second conductor sets 204 of second electrical cables 202 are terminated to a single linear array of contact elements 516. In the embodiment illustrated in FIGS. 7*f* and 8*f*, to facilitate this termination, the end portions of insulated conductors 206 extend substantially parallel from electrical cable 202 for proper alignment with corresponding contact elements 516 while the end portions of insulated conductors 106 are bent towards printed circuit board 514 for proper alignment with corresponding contact elements 516.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

The following items are exemplary embodiments of an electrical cable arrangement according to aspects of the present invention.

Item 1 is an electrical cable arrangement comprising: a first electrical cable comprising: first and second conductor sets, each conductor set including two or more substantially parallel longitudinal insulated conductors; and a first carrier film including cover portions at least partially covering each of the first and second conductor sets, and parallel portions extending from both sides of each of the first and second conductor sets, the parallel portions forming pinched portions of the first electrical cable, the cable comprising a first pinched portion between the first and second conductor sets; and a second electrical cable comprising: a third conductor set including two or more substantially parallel longitudinal insulated conductors; and a second carrier film including a cover portion at least partially covering the third conductor set, and parallel portions extending from both sides of the third conductor set, the parallel portions forming pinched portions of the second electrical cable, wherein the first electrical cable and the second electrical cable extend in substantially the same direction and are arranged in a nested configuration such that the insulated conductors of the third conductor set are disposed within the first pinched portion of the first electrical cable.

Item 2 is the electrical cable arrangement of item 1, wherein opposing sides of each of the first and second conductor sets and the third conductor set at least partially overlap.

Item 3 is the electrical cable arrangement of item 1, wherein the electrical cable arrangement has a thickness that is less than the combined thickness of the first electrical cable and the second electrical cable.

Item 4 is the electrical cable arrangement of item 1, wherein at least one of the first carrier film and the second carrier film includes a shielding film.

Item 5 is the electrical cable arrangement of item 4, wherein at least a portion of the shielding film is disposed between each of the first and second conductor sets and the third conductor set.

Item 6 is the electrical cable arrangement of item 1, wherein the first electrical cable and the second electrical cable are bonded together.

Item 7 is the electrical cable arrangement of item 1, wherein the insulated conductors of at least one of the first and second conductor sets and the third conductor set are configured for termination to a linear array of contact elements.

Item 8 is the electrical cable arrangement of item 1, wherein the insulated conductors of the first and second conductor sets are configured for termination to a first linear array of contact elements, and wherein the insulated conductors of the third conductor set are configured for termination to a second linear array of contact elements.

Item 9 is the electrical cable arrangement of item 8, wherein the first linear array of contact elements and the second linear array of contact elements are disposed in a single plane.

Item 10 is the electrical cable arrangement of item 8, wherein the first linear array of contact elements and the second linear array of contact elements are disposed in different planes.

Item 11 is the electrical cable arrangement of item 1 further comprising at least one longitudinal ground conductor extending in substantially the same direction as the one or more insulated conductors of at least one of the first and second conductor sets and the third conductor set.

Item 12 is the electrical cable arrangement of item 11, wherein the ground conductor is included in at least one of the first electrical cable and the second electrical cable.

Item 13 is the electrical cable arrangement of item 11, wherein the ground conductor is disposed between the first electrical cable and the second electrical cable.

Item 14 is the electrical cable arrangement of item 11, wherein the parallel portions and the insulated conductors of at least one of the first electrical cable and the second electrical cable are arranged generally in a single plane.

Item 15 is the electrical cable arrangement of item 11, wherein the parallel portions and the insulated conductors of at least one of the first electrical cable and the second electrical cable are arranged generally in different planes.

Item 16 is an electrical cable arrangement comprising: a first electrical cable comprising: a plurality of spaced apart first conductor sets arranged generally in a single plane, each first conductor set including two or more substantially parallel longitudinal insulated conductors, a minimum spacing between neighboring first conductor sets being a first distance; and two generally parallel first carrier films disposed around the first conductor sets; and a second electrical cable comprising: a plurality of spaced apart second conductor sets arranged generally in a single plane, each second conductor set including two or more substantially parallel longitudinal insulated conductors, a maximum width of the second conductor sets being a second distance less than the first distance; and two generally parallel second carrier films disposed around the second conductor sets, wherein the first electrical cable and the second electrical cable extend in substantially the same direction and are arranged in a nested configuration such that the first carrier films and second carrier films overlap along a thickness direction of the electrical cable arrangement.

Item 17 is the electrical cable arrangement of item 16, wherein at least one of the first carrier films and the second carrier films includes a shielding film.

Item 18 is the electrical cable arrangement of item 17, wherein at least a portion of the shielding film is disposed between the first conductor sets and the second conductor sets.

Item 19 is the electrical cable arrangement of item 16, wherein the insulated conductors of at least one of the first conductor sets and the second conductor sets are configured for termination to a linear array of contact elements.

Item 20 is an electrical cable arrangement comprising first and second shielded electrical cables, each cable comprising: a plurality of conductor sets extending along a length of the cable and being spaced apart from each other along a width of the cable, each conductor set including one or more insulated conductors; and first and second shielding films disposed on opposite sides of the cable, the first and second shielding films including cover portions and pinched portions arranged such that, in transverse cross section, the cover portions of the first and second shielding films in combination substantially surround each conductor set, and the pinched portions of the first and second shielding films in combination form pinched portions of the cable on each side of each conductor set, the second shielded electrical cable being disposed on the first shielded electrical cable such that the conductor sets of each cable are at least partially disposed within the pinched portions of the other cable.

Item 21 is the electrical cable arrangement of item 20, wherein the shielding films of the first and second shielded electrical cables overlap along a thickness direction of the electrical cable arrangement.

Item 22 is the electrical cable arrangement of item 20, wherein at least one of the first and second shielded electrical cables comprises a conductor set that comprises two or more insulated conductors.

Item 23 is the electrical cable arrangement of item 20 having a maximum thickness that is at least 40% less than a sum of maximum thicknesses of the first and second shielded electrical cables.

Item 24 is the electrical cable arrangement of item 20 having a minimum thickness that is at most 40% greater than a sum of minimum thicknesses of the first and second shielded electrical cables.

Item 25 is the electrical cable arrangement of item 20, wherein the first shielding film of at least one of the first and second shielded electrical cables is more planar than the second shielding film.

Item 26 is an electrical cable arrangement comprising first and second shielded electrical cables, each cable comprising: a plurality of conductor sets extending along a length of the cable and being spaced apart from each other along a width of the cable, each conductor set including one or more insulated conductors; and first and second shielding films disposed on opposite sides of the cable, the first and second shielding films including cover portions and pinched portions arranged such that, in transverse cross section, the cover portions of the first and second shielding films in combination substantially surround each conductor set, and the pinched portions of the first and second shielding films in combination form pinched portions of the cable on each side of each conductor set, the second shielded electrical cable being disposed on the first shielded electrical cable such that when the electrical cable arrangement is in a planar configuration, the shielding films of the first and second shielded electrical cables overlap along a thickness direction of the cable arrangement.

Item 27 is the electrical cable arrangement of item 26, wherein the conductor sets of each cable are at least partially disposed within the pinched portions of the other cable.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical cable arrangement comprising:

a first electrical cable comprising:

first and second conductor sets, each conductor set including two or more substantially parallel longitudinal insulated conductors; and a first carrier film including cover portions at least partially covering each of the first and second conductor sets, and parallel portions extending from both sides of each of the first and second conductor sets, the parallel portions forming pinched portions of the first electrical cable, the cable comprising a first pinched portion between the first and second conductor sets; and a second electrical cable comprising:

a third conductor set including two or more substantially parallel longitudinal insulated conductors; and a second carrier film including a cover portion at least partially covering the third conductor set, and parallel portions extending from both sides of the third conductor set, the parallel portions forming pinched portions of the second electrical cable, wherein the first electrical cable and the second electrical cable extend in substantially the same direction and are arranged in a nested configuration such that the insulated conductors of the third conductor set are disposed within the first pinched portion of the first electrical cable, and wherein only one of the first carrier film and the second carrier film comprises a shielding film resulting in one layer of shielding between the first conductor set and the third conductor set.

2. The electrical cable arrangement of claim 1, wherein opposing sides of each of the first and second conductor sets and the third conductor set at least partially overlap.

3. The electrical cable arrangement of claim 1, wherein the electrical cable arrangement has a thickness that is less than the combined thickness of the first electrical cable and the second electrical cable.

4. The electrical cable arrangement of claim 1, wherein the insulated conductors of at least one of the first and second conductor sets and the third conductor set are configured for termination to a linear array of contact elements.

5. An electrical cable arrangement comprising:

a first electrical cable comprising:

a plurality of spaced apart first conductor sets arranged generally in a single plane, each first conductor set including two or more substantially parallel longitudinal insulated conductors, a minimum spacing between neighboring first conductor sets being a first distance; and two generally parallel first carrier films disposed around the first conductor sets; and a second electrical cable comprising:

a plurality of spaced apart second conductor sets arranged generally in a single plane, each second conductor set including two or more substantially parallel longitudinal insulated conductors, a maximum width of the second conductor sets being a second distance less than the first distance; and two generally parallel second carrier films disposed around the second conductor sets, wherein the first electrical cable and the second electrical cable extend in substantially the same direction and are arranged in a nested configuration such that the first carrier films and second carrier films overlap along a thickness direction of the electrical cable arrangement, wherein the insulated conductors of the first electrical cable are terminated to a first linear array of contact elements disposed on one side of a printed circuit board, and the insulated conductors of the second electrical cable are terminated to a second linear array of contact elements disposed on an opposite side of the printed circuit board.

6. An electrical cable arrangement comprising:

a first electrical cable comprising:

a plurality of spaced apart first conductor sets arranged generally in a single plane, each first conductor set including two or more substantially parallel longitudinal insulated conductors, a minimum spacing between neighboring first conductor sets being a first distance; and two generally parallel first carrier films disposed around the first conductor sets;

a second electrical cable comprising:

a plurality of spaced apart second conductor sets arranged generally in a single plane, each second conductor set including two or more substantially parallel longitudinal insulated conductors, a maximum width of the second conductor sets being a second distance less than the first distance; and two generally parallel second carrier films disposed around the second conductor sets, wherein the first electrical cable and the second electrical cable extend in substantially the same direction and are arranged in a nested configuration such that the first carrier films and second carrier films overlap along a thickness direction of the electrical cable arrangement; and one or more ground conductors disposed between the first electrical cable and the second electrical cable.

* * * * *

UNITED STATES PATENT AND TRADEMARK OFFICE

CERTIFICATE OF CORRECTION

PATENT NO. : 9,287,020 B2
APPLICATION NO. : 13/817496
DATED : March 15, 2016
INVENTOR(S) : Gundel et al.

It is certified that error appears in the above-identified patent and that said Letters Patent is hereby corrected as shown below:

In the specification,

Column 8

Line 28, delete "408′" and insert -- 408‴ --

Line 32, delete "508′" and insert -- 508‴ --

Line 59, delete "808′" and insert -- 808‴ --

Column 9

Line 1, delete "908′" and insert -- 908‴ --

Line 36, delete "808′" and insert -- 808‴ --

Signed and Sealed this
Twenty-third Day of August, 2016

Michelle K. Lee

Michelle K. Lee
*Director of the United States Patent and Trademark Office*